US008454143B2

(12) United States Patent
Takeuchi

(10) Patent No.: US 8,454,143 B2
(45) Date of Patent: Jun. 4, 2013

(54) LIQUID CONTAINER, METHODS OF ASSEMBLING OR DISASSEMBLING LIQUID CONTAINER, AND IMAGE FORMING APPARATUS

(75) Inventor: Shotaro Takeuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 371 days.

(21) Appl. No.: 12/870,222

(22) Filed: Aug. 27, 2010

(65) Prior Publication Data

US 2011/0057997 A1 Mar. 10, 2011

(30) Foreign Application Priority Data

Sep. 4, 2009 (JP) ..... 2009-205193

(51) Int. Cl.
*B41J 2/175* (2006.01)

(52) U.S. Cl.
USPC ..... 347/86

(58) Field of Classification Search
USPC ..... 347/84, 85, 86, 87
See application file for complete search history.

(56) References Cited

U.S. PATENT DOCUMENTS

| | | | | |
|---|---|---|---|---|
| 6,010,210 | A * | 1/2000 | Wilson et al. | 347/85 |
| 6,170,937 | B1 | 1/2001 | Childers et al. | |
| 6,243,115 | B1 * | 6/2001 | Baker et al. | 347/85 |
| 6,609,789 | B1 | 8/2003 | Hunt | |
| 2004/0201654 | A1 | 10/2004 | Morita | |
| 2009/0167809 | A1 | 7/2009 | Kondo | |
| 2009/0256892 | A1 | 10/2009 | Takeuchi | |
| 2009/0273655 | A1 | 11/2009 | Song et al. | |

FOREIGN PATENT DOCUMENTS

| | | |
|---|---|---|
| JP | 2002-505212 | 2/2002 |
| JP | 2006-82290 | 3/2006 |
| WO | WO2006/070981 A1 | 7/2006 |

OTHER PUBLICATIONS

Nov. 15, 2010 European search report in connection with counterpart European patent application No. 10 25 1527.
Chinese official action dated Oct. 16, 2012 in corresponding Chinese patent application No. 201010277478.0.

* cited by examiner

*Primary Examiner* — Anh T. N. Vo
(74) *Attorney, Agent, or Firm* — Cooper & Dunham LLP

(57) ABSTRACT

A liquid container includes a case and a liquid containing bag contained in the case. The case includes an integrally formed hollow body having a front opening portion, a rear opening portion, and a supply-opening fixing portion. The supply-opening fixing portion is disposed on a front end of the hollow body and to which a supply opening portion of the liquid containing bag is fixedly attached. The case includes a front cover covering the front opening portion, and a rear cover covering the rear opening portion. The front opening portion is sized such that the liquid containing bag after use can be pulled out of the hollow body via the front opening portion. The rear opening portion is sized such that the liquid containing bag filled with ink can be inserted into the hollow body via the rear opening portion.

20 Claims, 14 Drawing Sheets

LIQUID CONTAINER, METHODS OF ASSEMBLING OR DISASSEMBLING LIQUID CONTAINER, AND IMAGE FORMING APPARATUS

BACKGROUND OF THE INVENTION

1. Field of the Invention

The present invention generally relates to liquid containers, methods of assembling and disassembling liquid containers, and image forming apparatuses.

2. Description of the Related Art

There are various types of image forming apparatuses, such as printers, facsimile machines, copy machines, plotters, and multifunction peripherals incorporating multiple image forming functions. For example, an inkjet recording apparatus is a fluid-discharging type printer that discharges droplets of ink using a recording head. The discharged droplets of ink attach onto a recording medium, such as a sheet of paper, an OHP sheet, or any other material onto which ink droplets or other fluid can attach in order to form, print, record, or transfer an image on the recording medium. The image forming apparatus of the fluid-discharging type includes a serial type and a line type. In the serial type, the recording head is moved in a main-scan direction as it discharges ink droplets. In the line type, the recording head discharges ink droplets without moving.

The recording medium on which an image is formed by the image forming apparatus of the fluid-discharge type may include various materials, such as paper, threads, fibers, cloth, leather, metal, plastics, glass, wood, and ceramics. The "image" printed, formed, or recorded on, or transferred onto, for example, the recording medium may include not only meaningful characters or figures but also random or apparently meaningless shapes or patterns. The "ink" may include a recording fluid, a fixing-treatment fluid, a DNA sample, a resist fluid, or any other fluid capable of forming an image on the recording medium. The "image" refers not only to two-dimensional images but also three-dimensional images, such as an image printed on a three-dimensional object.

Typically, an inkjet recording apparatus (image forming apparatus) includes a sub-tank (which may be referred to as a "buffer tank" or "a head tank") and an ink cartridge (which may be referred to as a "main tank"). The sub-tank is mounted on a carriage that carries a recording head, and ink is supplied from the sub-tank to the recording head. The main tank is detachably attached to a hollow body of the image forming apparatus (which may be hereafter referred to as an "apparatus main body"). The sub-tank is supplied with ink from the main tank, and the ink is then supplied from the sub-tank to the recording head.

The ink cartridge (main tank) may have a double-bag structure within a cartridge case in which an outer air bag is disposed outside an inner ink bag into which outer bag compressed air is introduced. By supplying the compressed air into the outer air bag, the inner ink bag is pressurized, thus causing the ink to be supplied from the ink bag to the sub-tank. In such a pressurized ink cartridge, the cartridge case is subject to a high pressure. There is also an increasing trend to increase the pressure applied to the cartridge so as to increase the volume of ink supplied per unit time for achieving higher printing speed, or to enable the supply of high-viscosity ink having a quick-drying property.

Patent Document 1 discloses an ink cartridge that includes a thin, substantially rectangular-solid shaped cartridge case in which an ink pack is housed. The cartridge case includes a hollow body and a lid portion. Patent Document 2 discloses that ink is contained in a bottle-shaped case formed by blow molding.

Patent Document 1: JP2006-82290A

Patent Document 2: JP2002-505212A

As mentioned above, there is a need to increase the supply of ink in a stable manner for increasing the speed of image formation. The ink cartridge according to Patent Document 1 includes a hollow body and a lid portion that are divided along a plane parallel to two of the six faces of the rectangular solid shape that have the largest areas. As a result, when a large load is applied to the cartridge case, the hollow body and the lid portion may break apart along the dividing plane.

On the other hand, there is also the demand to fill the ink bag with "deaerated ink" from which air is removed as much as possible in order to prevent air from entering a fluid supply channel of an image forming apparatus. In one method to fill the ink bag while preventing the entry of air into ink, air may be initially suctioned from an ink bag via its inlet, with the ink bag retained in place with a pair of flat plates and the like in a smoothly folded state, and then ink is injected into the ink bag which is in a reduced-pressure condition, followed by hermetically sealing the inlet. In another method, after the ink bag is filled with ink via its inlet, the ink bag is disposed such that the inlet is facing downward, so that air collects at the top opposite to the inlet. The ink bag is then hermetically sealed such that the upper portion of the ink bag where the air is mixed with ink is isolated. In any of these methods, the ink bag needs to be filled with ink before the ink bag is housed in the cartridge case.

However, in the case of the bottle-shaped case discussed in Patent Document 2, the inlet of the case is reduced in size so as to increase the pressure resistance of the cartridge case. Thus, an ink bag filled with ink cannot be housed in the case during assembly; namely, the ink cannot be deaerated by any of the aforementioned methods.

SUMMARY OF THE INVENTION

In one aspect, the invention may provide a liquid container that includes a case and a liquid containing bag housed in the case. The case includes an integrally formed hollow body having a front opening portion, a rear opening portion, and a supply-opening fixing portion. The supply-opening fixing portion is disposed on a front end of the hollow body and to which a supply opening portion of the liquid containing bag is fixedly attached. The case includes a front cover covering the front opening portion, and a rear cover covering the rear opening portion. The front opening portion is sized such that the liquid containing bag after use can be pulled out of the hollow body via the front opening portion. The rear opening portion is sized such that the liquid containing bag filled with ink can be inserted into the hollow body via the rear opening portion.

In another aspect, the invention may provide a method of assembling the liquid container, comprising the steps of inserting the liquid containing bag filled with the liquid into the hollow body via the rear opening portion; attaching the supply opening of the liquid containing bag to the supply-opening fixing portion of the hollow body; attaching the front cover to the front opening portion of the hollow body; and attaching the rear cover to the rear opening portion of the hollow body.

In another aspect, the invention may provide a method of disassembling the liquid container, comprising the steps of removing the front cover from the front opening portion of the hollow body; and pulling the liquid containing bag from the hollow body via the front opening portion.

In yet another aspect, the invention may provide an image forming apparatus that includes the liquid container. The liquid container is detachably attached to a hollow body of the image forming apparatus.

DESCRIPTION OF THE PREFERRED EMBODIMENTS

Figure 1:
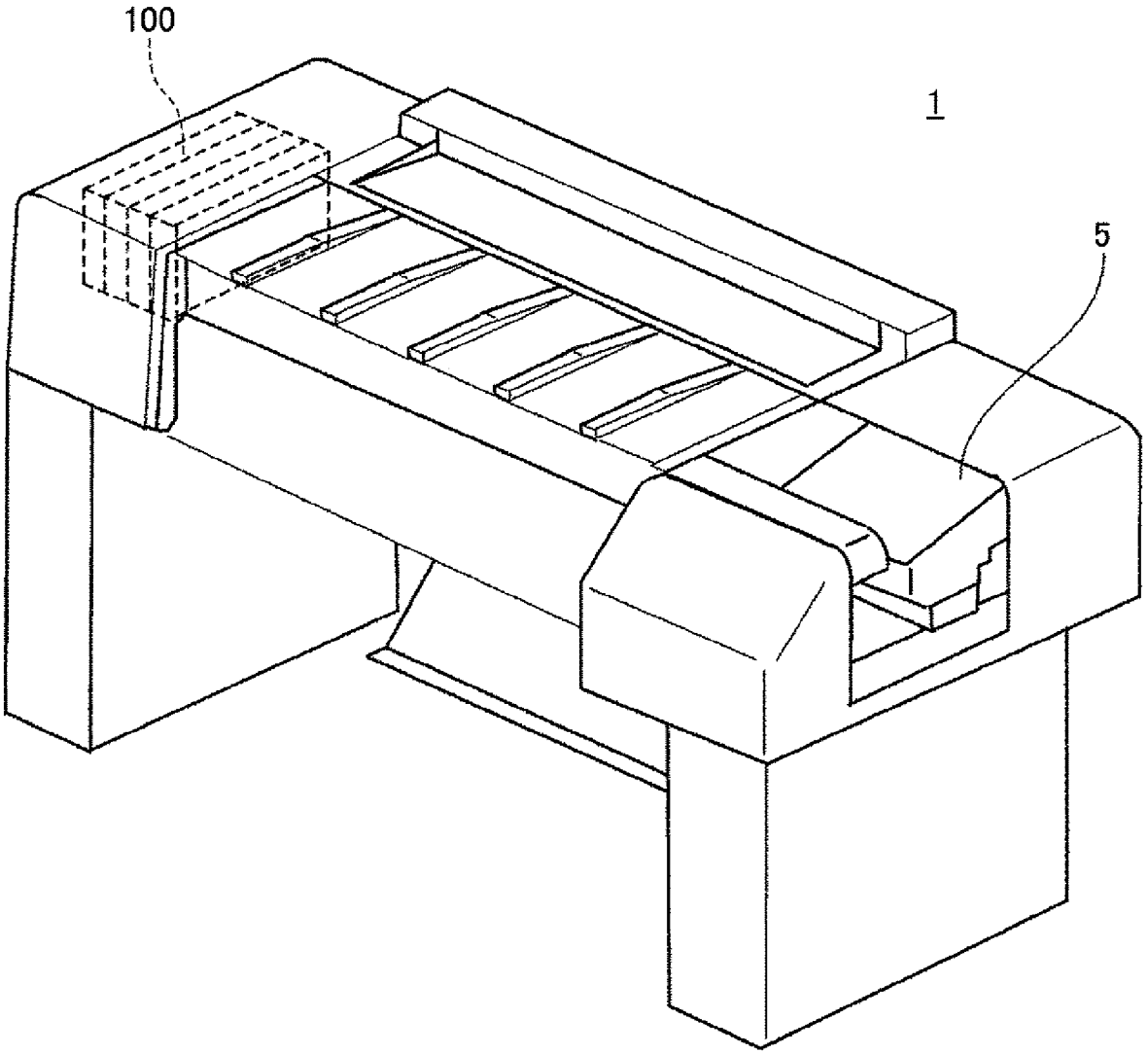
FIG. 1 is a perspective view of an inkjet recording apparatus (image forming apparatus) according to an embodiment of the present invention.
Figure 2:
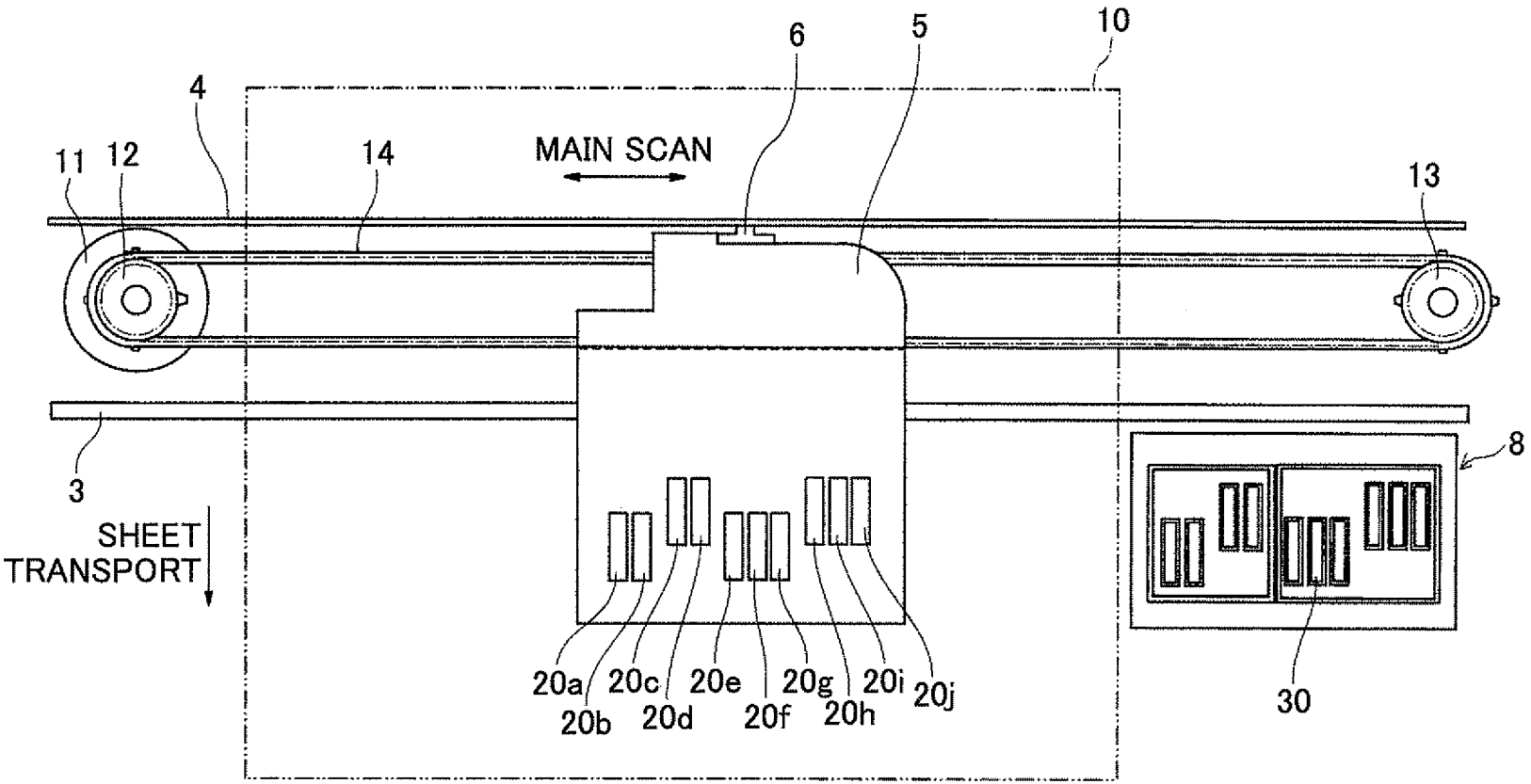
FIG. 2 is a schematic plan view of a printing mechanism unit of the inkjet recording apparatus of FIG. 1.

FIG. 1 is a perspective view of an inkjet recording apparatus 1 according to an embodiment of the present invention. The inkjet recording apparatus 1 is a serial-type image forming apparatus that includes a carriage 5 and ink cartridges (main tank) 100. FIG. 2 is a top plan view of a printing mechanism unit of the inkjet recording apparatus 1. The carriage 5 is slidably supported by a guide rod 3 and a guide rail 4 fixed between side plates (not shown) within a hollow body of the inkjet recording apparatus 1 ("apparatus main body"). Thus, the carriage 5 can be slidably moved in a main scan direction indicated by a both-ends arrow. The carriage 5 may be configured to be guided along the guide rail 4 via a sub-guide roller 6 rotatably supported on a rear portion of the carriage 5.

The carriage 5 is moved in the main-scan direction by a main scan mechanism which may include a drive motor 11 disposed at one end of a main scan path along the main-scan direction, a drive pulley 12 rotated by the drive motor 11, a driven pulley 13 disposed at the other end of the main scan path, and a timing belt (belt member) 14 extended across the drive pulley 12 and the driven pulley 13. The driven pulley 13 may be biased in a direction away from the drive pulley 12 by a tensioning spring (not shown). The drive pulley 12 and the driven pulley 13 are disposed such that their axes are parallel to a direction in which ink droplets are discharged, which is perpendicular to the sheet of the drawing of FIG. 2 (i.e., from the upper surface of the sheet to the bottom surface). A part of the belt member 14 is fixed to a belt-fixing portion of the carriage 5 at a rear portion (which is at the top of FIG. 2). Thus, the belt member 14 is disposed on one side (i.e., rear) of the carriage 5.

Figure 3:
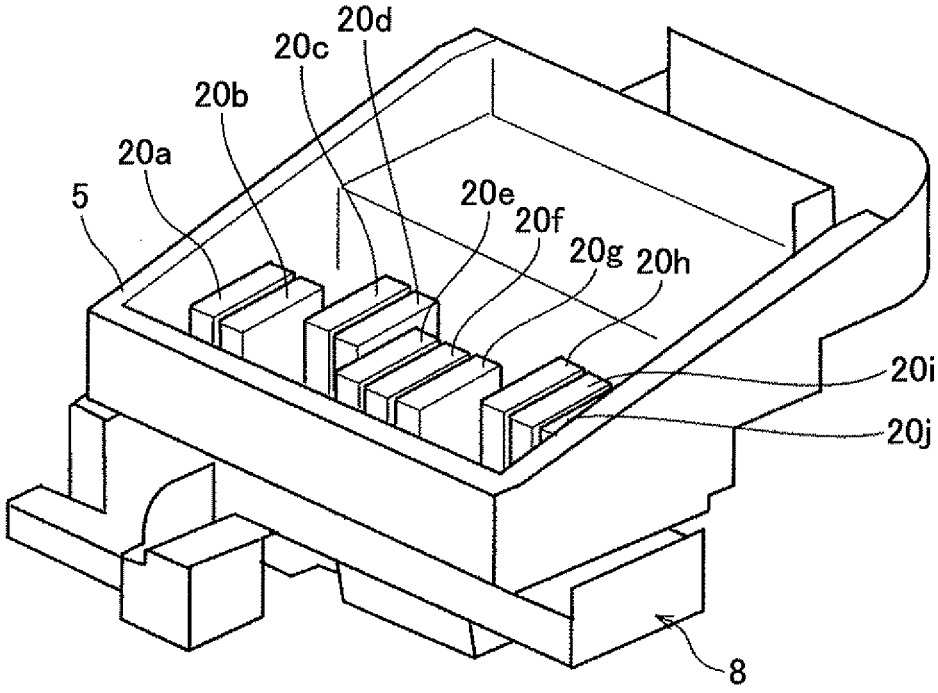
FIG. 3 is a perspective view of a carriage on which recording heads are mounted, and a maintain/recover mechanism located below the carriage.

Referring to FIGS. 2 and 3, the carriage 5 carries recording heads 20*a* through 20*j* (any of which may be referred to as "the recording head 20"). The recording heads 20*a* through 20*j* may include nozzles (not shown in FIGS. 2 and 3) via which ink droplets of the colors black (K), yellow (Y), magenta (M), and cyan (C) are discharged, and corresponding buffer tanks (sub-tanks) 22 (see FIG. 4). A pair of the recording heads 20*a* and 20*b* and a pair of the recording heads 20*c* and 20*d* are disposed in a staggered manner with respect to a sheet transport direction indicated by an arrow (which is downward in the sheet of FIG. 2). These pairs of the recording heads may be configured to discharge ink droplets of black. A group of the recording heads 20*e* through 20*g* and a group of the recording heads 20*h* through 20*j* are also disposed in a staggered manner in the sheet transport direction. The recording heads 4*e* and 4*h* may be configured to discharge ink droplets of cyan. The recording heads 20*f* and 20*i* may be configured to discharge ink droplets of magenta. The recording heads 20*g* and 20*j* may be configured to discharge ink droplets of yellow. Thus, an area corresponding to two heads in the sheet transport direction are printed for each color in one main scan.

A sheet 10 is transported in the sheet transport direction, which is a sub-scan direction perpendicular to the main scan direction, by a sheet-transport mechanism (not shown) in an intermittent manner. A maintain/recover mechanism 8 is disposed at one end of a main scan area corresponding to the width of the sheet 10. The maintain/recover mechanism 8 may include a cap 30 for capping a nozzle surface of the recording head 20, and a wiper member configured to wipe the nozzle surface. The ink cartridges (main tank) 100 are detachably mounted outside the main scan area as illustrated in FIG. 1. It is noted that in FIG. 1, the carriage 5 is positioned above the maintain/recover mechanism 8, i.e., at the right-hand end of the main-scan direction, as also illustrated in FIG. 3. In FIG. 2, the carriage 5 is positioned within the main-scan area. The ink cartridges 100 contain the various colors of ink supplied to the recording head 20.

In the inkjet recording apparatus 1, the recording head 20 is driven in accordance with an image information signal in order to discharge the various colors of ink droplets onto the sheet 10 while the carriage 5 is moved in the main scan direction and the sheet 10 is intermittently moved in the sub-scan direction, so that a desired image can be formed on the sheet 10.

Figure 4:
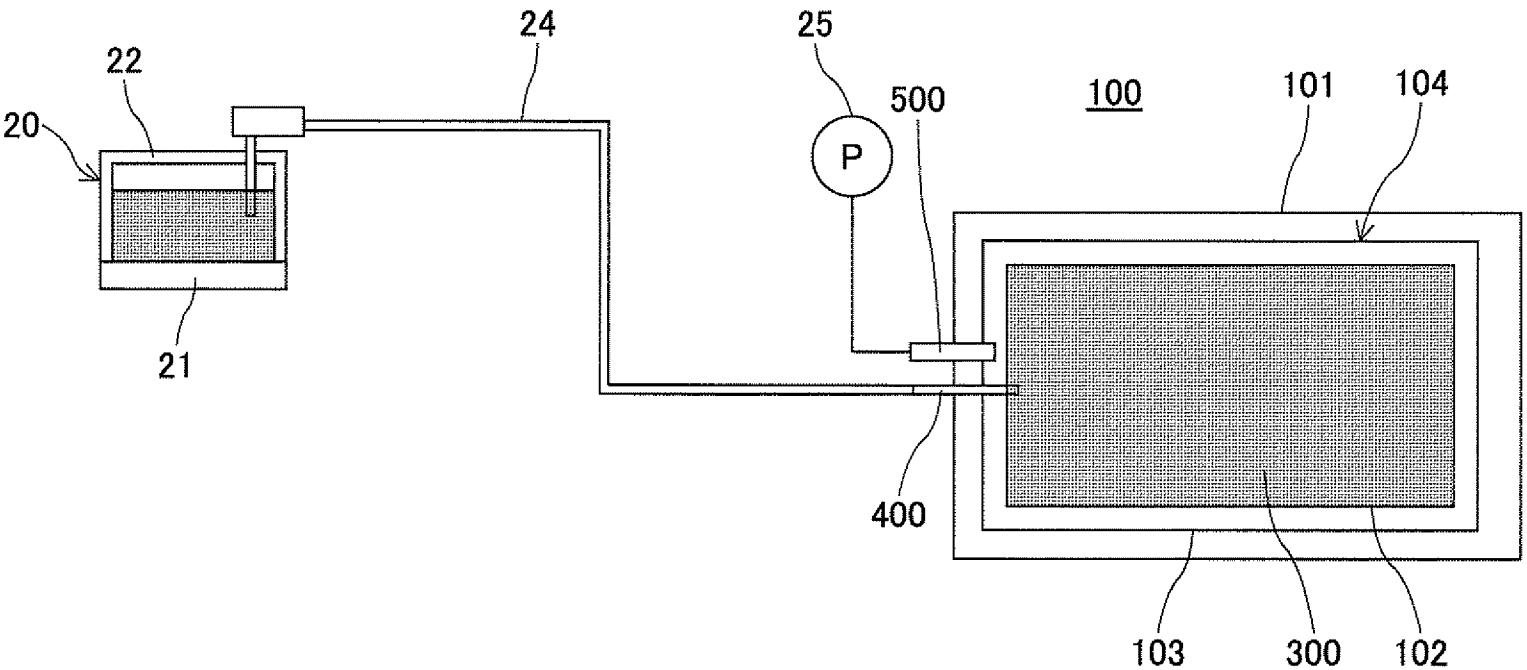
FIG. 4 is a schematic diagram of an ink supply system of the inkjet recording apparatus.

An ink supply system of the inkjet recording apparatus 1 is described with reference to FIG. 4. The ink supply system includes the recording head 20, a supply tube 24, a pump 25, and the ink cartridge 100. The recording head 20 includes a nozzle portion 21 configured to discharge an ink droplet, and a buffer tank (sub-tank) portion 22 configured to supply ink to the nozzle portion 21. The ink cartridge 100 (liquid container) is a replaceable main tank that contains ink supplied to the recording head 20. The ink in the ink cartridge 100 is supplied to the buffer tank 22 via the supply tube 24.

The ink cartridge 100 includes a cartridge case 101 in which a double-bag 104 (liquid containing bag) is housed. The double-bag 104 includes an ink bag 102 (inner bag) in which ink 300 (liquid) is contained, and an air bag 103 (outer bag) that contains the ink bag 102. When a gas (such as air) is introduced into the air bag 103, the air bag 103 inflates and thereby applies pressure to the ink bag 102, thus causing the ink 300 in the ink bag 102 to be supplied outside the ink cartridge 100. Specifically, air may be introduced into the air bag 103 using the pump 25 in order to supply the ink 300 to the recording head 20. The supply tube 24 is detachably connected to the ink bag 102 via a hollow needle 400, and the pump 25 is detachably connected to the air bag 103 via an air-joint portion 500.

Embodiment 1

Figure 5:
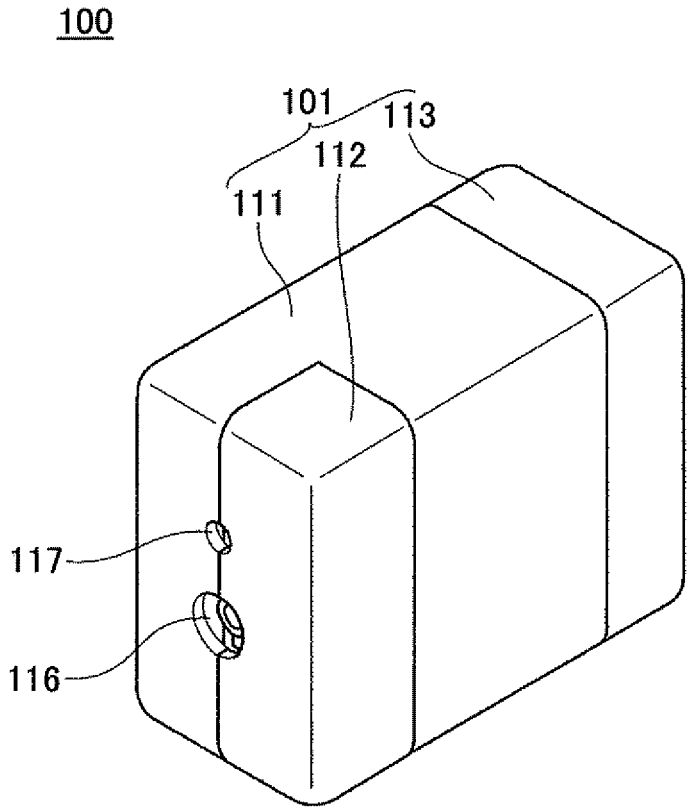
FIG. 5 is a perspective view of an ink cartridge according to Embodiment 1 of the present invention.
Figure 6:
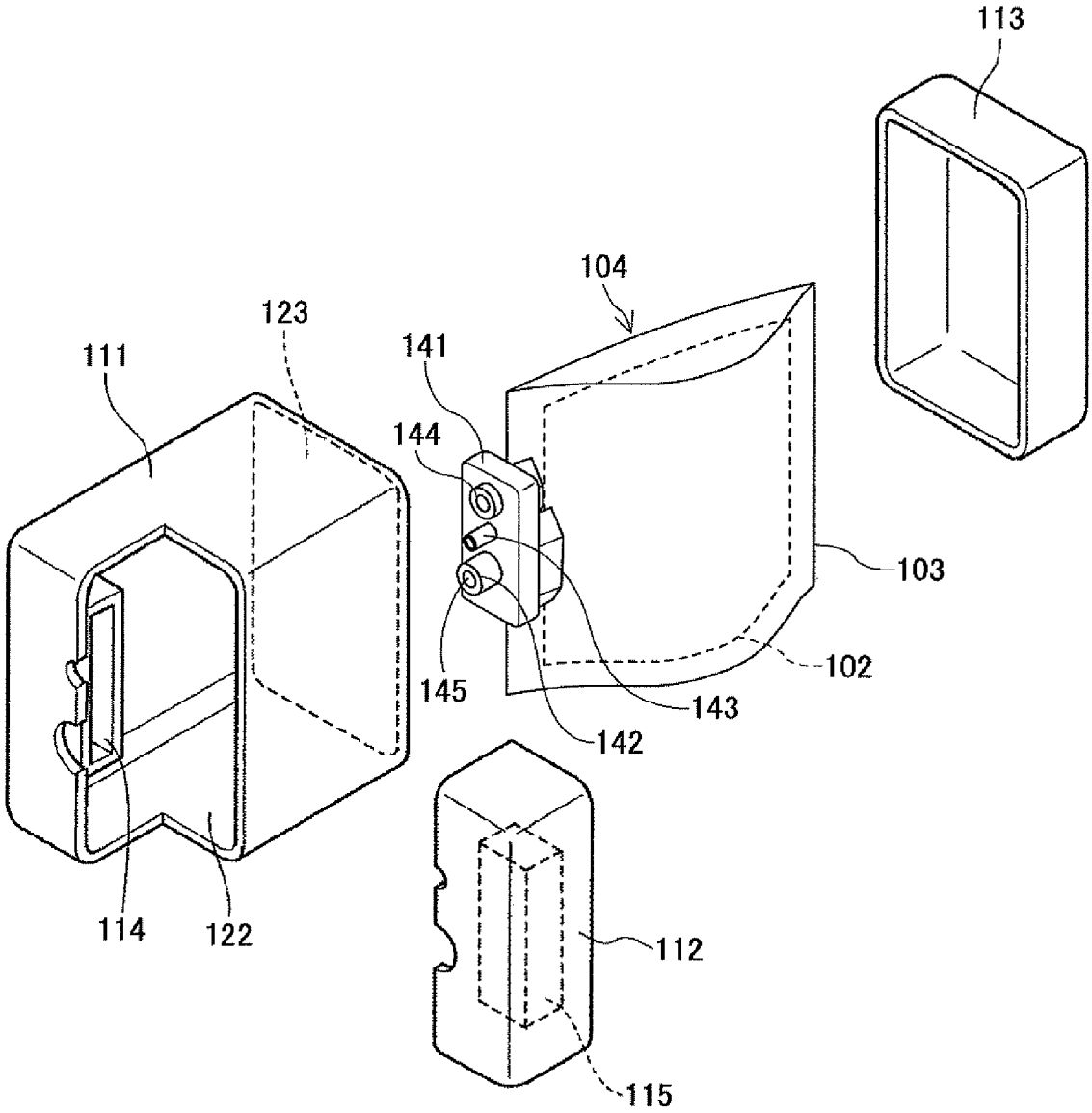
FIG. 6 is an exploded perspective view of the ink cartridge of Embodiment 1.

The ink cartridge 100 according to Embodiment 1 of the present invention is described with reference to FIGS. 5 and 6. FIG. 5 is a perspective view of the ink cartridge 100. FIG. 6 is an exploded perspective view of the ink cartridge 100. The ink cartridge 100 includes the cartridge case 101. The cartridge case 101 houses the double-bag 104, which includes the ink bag 102 containing ink and the air bag 103 that contains the ink bag 102. As described above, the air bag 103 is configured to be supplied with gas, such as air, so as to inflate and thereby apply pressure to the ink bag 102 in order to cause the ink to be supplied out of the ink cartridge 100.

Referring to FIG. 6, the ink bag 102 and the air bag 103 are fixedly attached to a spout 141 (joint member) which may be made of polyethylene or other resin material, by thermal fusing and the like, with the ink bag 102 located inside the air bag 103. The spout 141 has an ink supply opening 142 for supplying ink to the sub-tank 22, an ink inlet 143 for supplying ink to the ink bag 102, and an air inlet 144 for introducing air into the air bag 103. The ink supply opening 142 is internally fitted with a rubber seal 145. When the ink cartridge 100 is attached to the apparatus main body, the hollow needle 400 at the end of the supply tube 24 of the ink supply system as described above (FIG. 4) pierces the rubber seal 145, thus providing fluid communication between the ink bag 102 and the apparatus main body. Even if the ink cartridge 100 is detached from the inkjet recording apparatus 1 with some ink remaining in the ink cartridge 100, the ink does not flow out of the ink cartridge 100 because of the resilience of the rubber seal 145 which closes the opening formed in the rubber seal 145 where the hollow needle 400 had pierced.

After the ink bag 102 is filled with ink via the ink inlet 143, the ink inlet 143 may be hermetically sealed by thermal fusing and the like. When filling the ink bag 102 with ink, the ink bag 102 may be first evacuated by suctioning air out of it via the ink inlet 143, with the ink bag 102 compressed between a pair of flat boards and the like so as to keep the ink bag 102 flattened. In this way, entry of air into the ink in the ink bag 102 may be minimized. The air inlet 143 is in communication with the air bag 103 and is configured to introduce pressurized air from the apparatus main body into the air bag 103 so as to apply pressure to the ink bag 102 in a compressing direction during a print operation, for example.

As illustrated in FIGS. 5 and 6, the cartridge case 101 includes a hollow body 111 configured to house the double-bag 104, a front cover 112 configured to cover a front opening portion 122 of the hollow body 111, and a rear cover 113 configured to cover a rear opening portion 123 of the hollow body 111. The front cover 112 and the rear cover 113 may be fixed to the hollow body 111 by various methods, such as by using screws, snap-fitting, fusing, or bonding, individually or in combination. The front opening portion 122 of the hollow body 111 is large enough that the double-bag 104 after use can be pulled out of the hollow body 111 via the front opening portion 122. The rear opening portion 123 is large enough that the double-bag 104 filled with ink can be inserted into the hollow body 111 via the rear opening portion 123.

The hollow body 111, the front cover 112, and the rear cover 113 may be made by injection molding of resin material, such as polystyrene or ABS (acrylonitrile butadiene styrene) resin. From the viewpoint of recycling of material, it may be desirable to make the three components from the same material. Preferably, however, the hollow body 111 alone may be made of a high-strength resin because the hollow body 111 may be subject to the greatest load upon pressure application to the ink bag 102.

The first spout fixing portion 114 is disposed on an inner surface of the hollow body 111 on the front opening 122 side. The first spout fixing portion 114 is configured such that the spout 141 of the double-bag 104 can be fixedly fitted in the first spout fixing portion 114. A second spout fixing portion 115 is disposed on an inner surface of the front cover 112. The second spout fixing portion 115 is also configured such that the spout 141 of the double-bag 104 can be fixedly fitted in the second spout fixing portion 115. Thus, by attaching the front cover 112 to the hollow body 111, the spout 141 can be fixed by the first and the second spout fixing portions 114 and 115. When the front cover 112 is attached to the hollow body 111, openings 116 and 117 are formed in a front surface of the cartridge case 101 at locations corresponding to the supply opening 142 and the air inlet 143, as illustrated in FIG. 5. These openings 116 and 117 allow access when connecting the hollow needle 400 and an air-joint portion 500 from the apparatus main body to the supply opening 142 and the air inlet 144, respectively.

When assembling the ink cartridge 100, the double-bag 104 filled with ink is inserted into the hollow body 111 via the rear opening portion 123, and the spout 141 of the double-bag 104 is fitted in the first spout fixing portion 114 of the hollow body 111. The spout 141 of the double-bag 104 is also fixed by the second spout fixing portion 115 of the front cover 112 by attaching the front cover 112 to the front opening portion 122. Thereafter, the rear cover 113 is attached to the rear opening portion 123. In this way, the double-bag 104 containing deaerated ink can be housed within the cartridge case 101.

When disassembling the ink cartridge 100 after use, the front cover 112 is detached from the front opening portion 122 of the hollow body 111, and then the double-bag 104 is pulled out via the front opening portion 122. Thus, the double-bag 104 can be pulled out of the ink cartridge 100 for refill, for example, without having to detach the rear cover 113 from the hollow body 111.

Thus, in accordance with Embodiment 1 of the present invention, the portion of the cartridge case 101 to which the highest pressure may be applied, i.e., the hollow body 111 is formed as an integral member and not as an assembly of two or more components. Thus, the hollow body 111 can withstand a high pressure. By detaching the rear cover 113, the rear opening portion 123 can be exposed, thus providing an access opening via which the double-bag 104 (liquid containing bag) filled with deaerated liquid can be inserted into the cartridge case 101.

Embodiment 2

Figure 7:
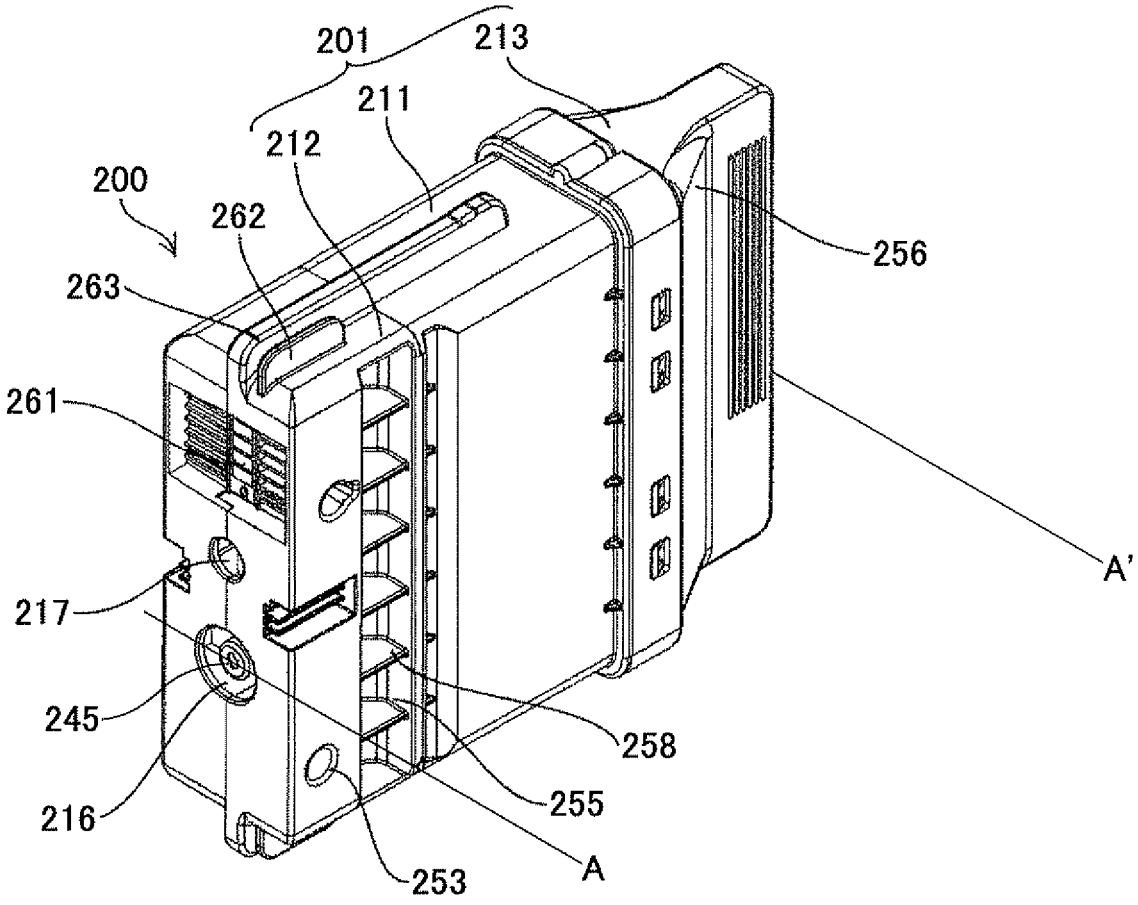
FIG. 7 is a perspective view of an ink cartridge according to Embodiment 2 of the present invention as seen from a front end of the ink cartridge.
Figure 8:
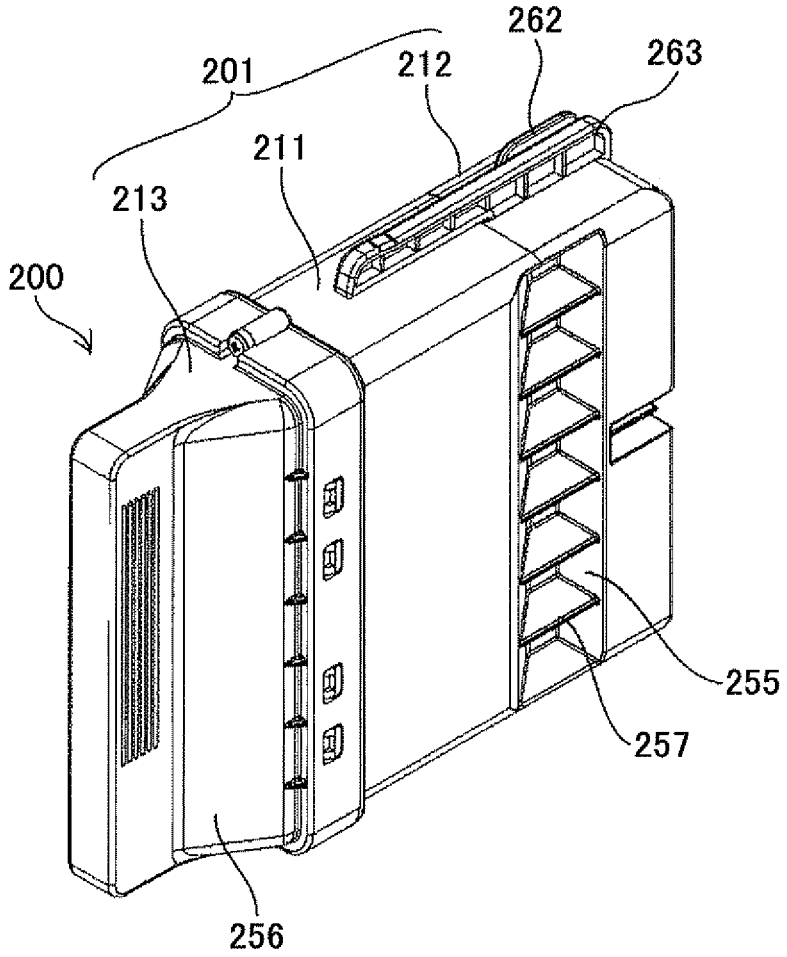
FIG. 8 is a perspective view of the ink cartridge of Embodiment 2 as seen from a rear end.
Figure 9:
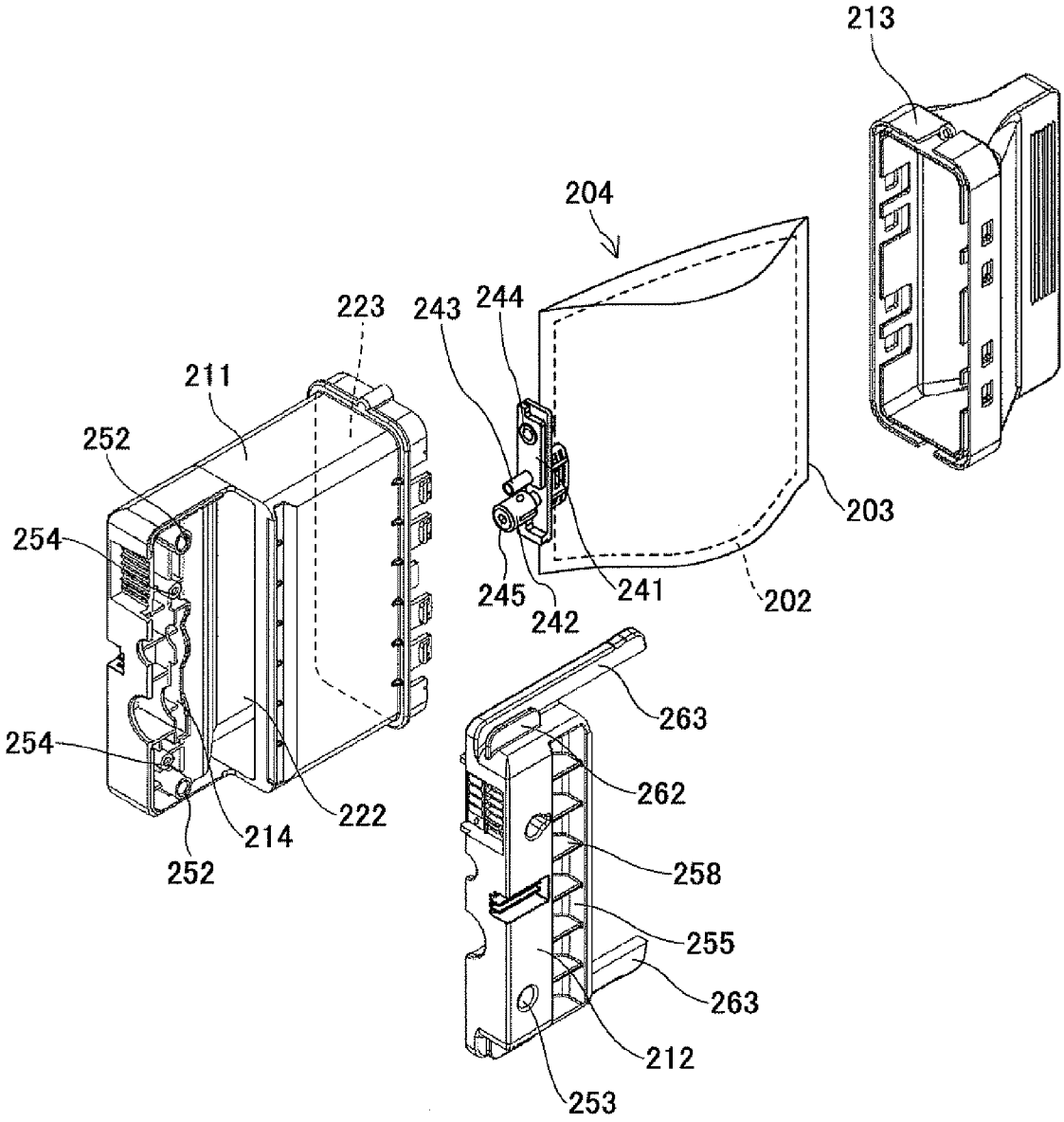
FIG. 9 is an exploded perspective view of the ink cartridge of Embodiment 2.
Figure 10:
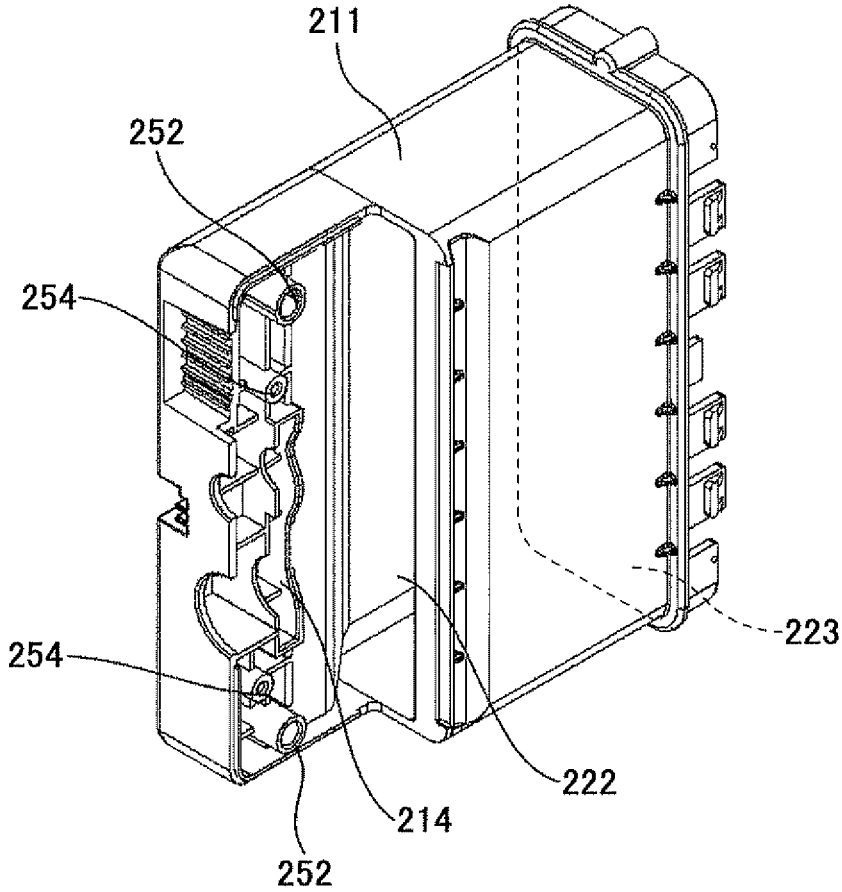
FIG. 10 is a perspective view of a hollow body of the ink cartridge of Embodiment 2.
Figure 11:
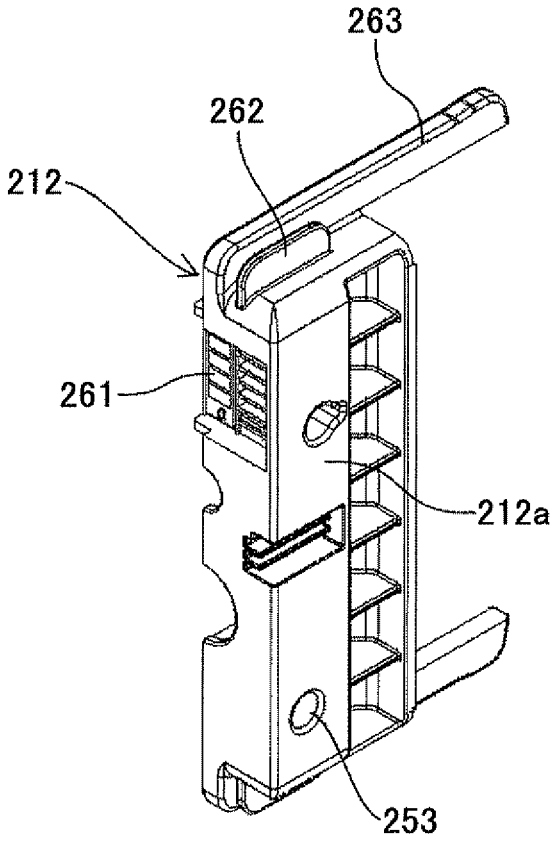
FIG. 11 is a perspective view of a front cover of the ink cartridge of Embodiment 2, illustrating a front end and one side of the front cover.
Figure 12:
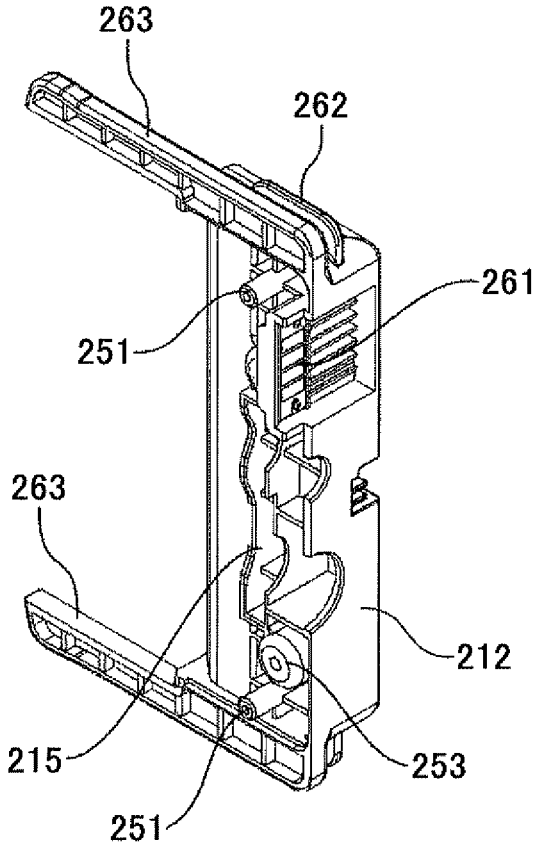
FIG. 12 is a perspective view of the front cover of the ink cartridge, illustrating the front end and the other side of the front cover.
Figure 13:
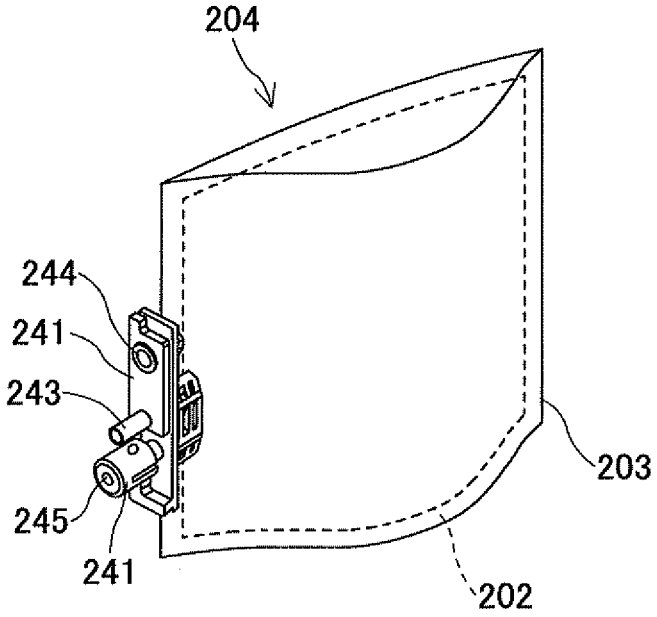
FIG. 13 is a perspective view of a double-bag of the ink cartridge of Embodiment 2.

An ink cartridge 200 (liquid container) according to Embodiment 2 of the present invention is described with reference to FIGS. 7 through 15. FIG. 7 is a perspective view of an ink cartridge 200 according to Embodiment 2, as seen from its front end. FIG. 8 is also a perspective view of the ink cartridge 200 as seen from its rear end. The ink cartridge 200 includes a cartridge case 201 in which a double-bag 204 (liquid containing bag; see FIG. 9) is housed. Referring to FIG. 9 which is an exploded perspective view of the ink cartridge 200, the double-bag 204 includes an ink (inner) bag 202 that contains ink, and an air (outer) bag 203 within which the ink bag 202 is contained. The air bag 203 is configured to be supplied with gas so as to apply pressure to the ink bag 202 within and thereby cause the ink in the ink bag 202 to be supplied outside the ink cartridge 200.

Figure 14:
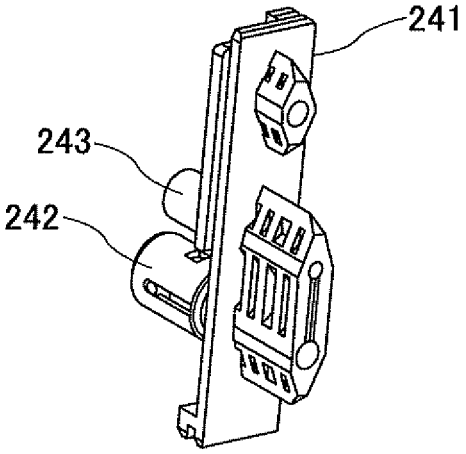
FIG. 14 is a perspective view of a spout portion of the double-bag of FIG. 13.

The ink bag 202 and the air bag 203 may be fixed to a spout 241 by thermal welding. As illustrated in FIG. 14, the spout 241 is a coupling member made of a resin material, such as polyethylene. The spout 241 has an ink supply opening 242 for supplying ink to the apparatus main body, an ink inlet 243 for filling the ink bag 202 with ink, and an air inlet 244 for introducing air (gas) into the air bag 203.

The ink supply opening 242 is internally fitted with a rubber seal 245 that is pierced by the hollow needle 400 from the apparatus main body when the ink cartridge 200 is attached to the apparatus main body, so as to allow fluid communication between the ink bag 202 and the apparatus main body. The resilience of the rubber seal 245 closes an opening formed in it where the rubber seal 245 is pierced by the hollow needle 400, so that the ink contained in the ink bag 202 does not flow out of the ink cartridge 200 even if the ink cartridge 200 is detached from the apparatus with some ink remaining in the ink cartridge 200.

The ink inlet 243 is in communication with the ink bag 202. After the ink bag 202 is filled with ink via the ink inlet 243, the ink inlet 243 may be hermetically sealed by thermal fusing and the like. When filling the ink bag 202 with ink, the ink bag 202 may be first evacuated by suctioning air via the ink inlet 243 with the ink bag 202 compressed between a pair of flat boards and the like so as to keep the ink bag 202 flattened. In this way, entry of air into the ink in the ink bag 202 can be minimized. The air inlet 243 is in communication with the air bag 203 and is configured to introduce pressurized air from the apparatus main body into the air bag 203 so as to apply pressure to the ink bag 202 in a compressing direction during a print operation, for example.

The cartridge case 201 includes a hollow body 211, a front cover 212 configured to cover a front opening portion 222 of the hollow body 211, and a rear cover 213 configured to cover a rear opening portion 223 of the hollow body 211. The front cover 212 may have a projecting portion 251, while the hollow body 211 may have a concave portion 252 shaped such that the projecting portion 251 of the front cover 212 can be fitted within the concave portion 252. Thus, the front cover 212 can be attached to the hollow body 211 using screws through openings 253 and 254, while ensuring their correct relative positions by the fitting of the projecting portion 251 in the concave portion 252. The front cover 212 and the rear cover 213 may be fixed to the hollow body 211 by various other methods, such as by using screws, snap-fitting, fusing, or bonding, individually or in combination. The hollow body 211 has the front opening portion 222 that is large enough that the double bag 204 after use can be pulled out via the front opening portion 222. The hollow body 211 also has the rear opening portion 223 that is large enough that the double bag 204 filled with ink can be installed via the rear opening portion 223.

The hollow body 211, the front cover 212, and the rear cover 213 may be made by injection molding of resin material, such as polystyrene or ABS (acrylonitrile butadiene styrene) resin. From the viewpoint of recycling of material, it may be desirable to make the three components from the same material. Preferably, however, the hollow body 211 alone may be made of a high-strength resin because the hollow body 211 may be subject to the greatest load upon pressure application to the ink bag 202.

The aforementioned first spout fixing portion 214 is disposed on an inner surface of the hollow body 211 at its front end. The first spout fixing portion 214 is configured such that the spout 241 of the double-bag 204 can be fixedly fitted in the first spout fixing portion 214. A second spout fixing portion 215 is disposed on an inner surface of the front cover 212. The second spout fixing portion 215 is positioned and configured such that, when the front cover 212 is attached to the hollow body 211, the spout 241 of the double-bag 204 can be fixed between the first and the second spout fixing portions 214 and 215. When the front cover 212 is attached to the hollow body 211, openings 216 and 217 are formed in the cartridge case 201 at locations corresponding to the supply opening 242 and the air inlet 243, respectively, as illustrated in FIG. 7. These openings 216 and 217 allow access when connecting the hollow needle 400 and the air-joint portion 500 from the apparatus main body to the supply opening 242 and the air inlet 244, respectively.

Figure 15:
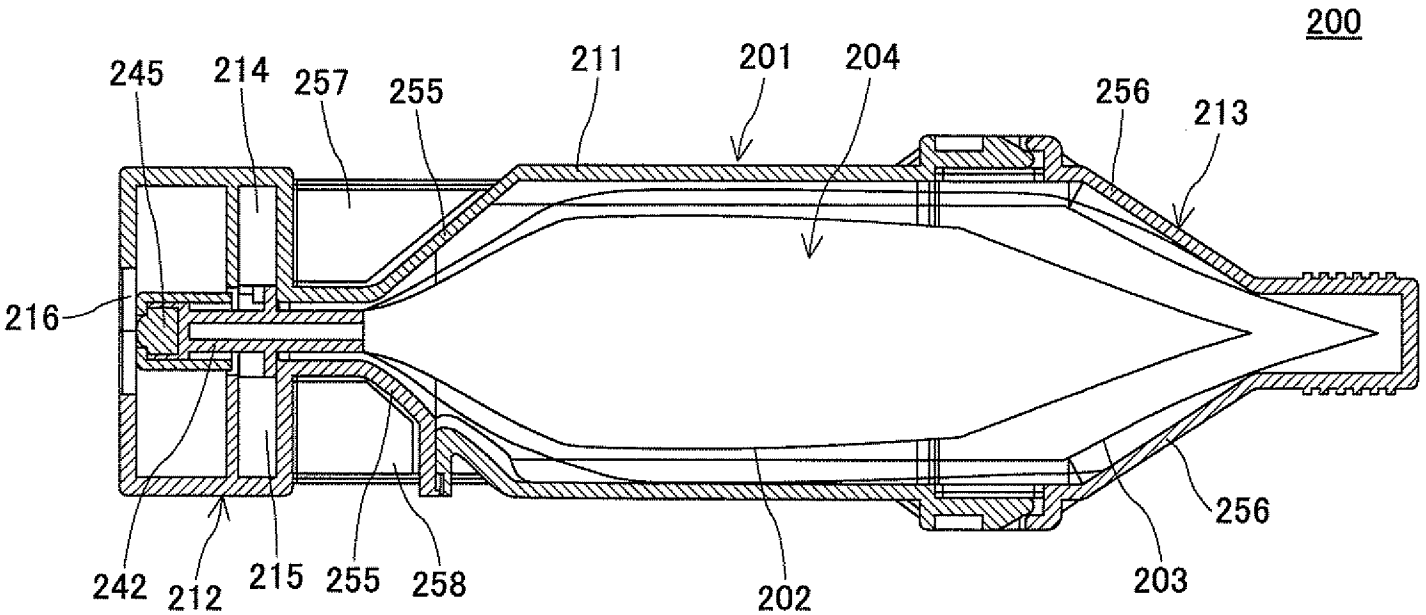
FIG. 15 is a cross section of the ink cartridge taken along line A-A' of FIG. 7.

The cartridge case 201, which is formed by the hollow body 211, the front cover 212, and the rear cover 213 may have angled portions at the front and rear ends, as illustrated in FIG. 15, for example, which is a cross section taken along line A-A' of FIG. 7. Specifically, front-side portions 255 and rear-side portions 256 of the cartridge case 201 may be angled such that the width of the cartridge case 201 gradually decrease towards the front and rear of the cartridge case 201 in conformity with the cross-sectional outer shape of the double-bag 204. On an outer surface of the front-side portion 255 of the front cover 212, buttressing ribs 258 are formed, as illustrated in FIG. 7. On an outer surface of the front-side portion 255 of the hollow body 211, buttressing ribs 257 are formed, as illustrated in FIG. 8. These buttressing ribs 257 and 258 are configured to make it difficult for the hollow body 211 or the front cover 212 to deform when pressure is applied to the ink bag 202. The internal wall surfaces of the cartridge case 201 may be smoothly formed so as to prevent the double-bag 204 from being scratched in case the cartridge case 201 is accidentally dropped, for example.

On a front surface of the front cover 212 (that comes at the front when the cartridge case 201 is attached to the apparatus main body), an ID chip 261 may be fixed by thermal welding or a double-sided adhesive tape. On the front cover 212 also, a color-identifying rib 262 having a color corresponding to the color of the contained ink may be integrally formed. The location of the color-identifying rib 262 may be varied depending on the color of the ink so that the attachment of the ink cartridge 200 having the wrong color to the apparatus main body can be prevented. The front cover 212 may also include a positioning rib 263 extending from a front cover hollow body 212*a* of the front cover 212 toward the rear cover 213, parallel to the direction in which the cartridge case 201 is attached to the apparatus main body, as illustrated in FIGS. 7 through 9 and particularly FIG. 11. The positioning rib 263 makes it possible to attach the cartridge case 201 to the apparatus main body with increased positional accuracy.

The areas of the cartridge case 201 around the buttressing ribs 257 and 258 (particularly those on the hollow body 211 and the front cover 212) have a relatively small amount of deformation upon application of pressure to the ink bag 202. Thus, it is desirable to attach the positioning rib 263, the ID chip 261, the spout fixing portions 214 and 215, the color-identifying rib 262, and other parts or components that require a high degree of positional accuracy (i.e., small tolerance for deformation) on or around the hollow body 211 or the front cover 212 in a concentrated manner.

Thus, by closing the opening portion 222 with the front cover 212, an enhanced strength of the cartridge case 201 can be obtained. Thus, deformation by pressure application can be prevented without having to increase the thickness of the cartridge case 201, while achieving required positioning accuracy.

When assembling the ink cartridge 200, the double-bag 204 filled with ink is inserted into the cartridge case 201 via the rear opening portion 223 of the hollow body 211, and then the spout 241 of the double-bag 204 is attached to the first spout fixing portion 214 of the hollow body 211. After the front cover 212 is attached to the opening portion 222 of the hollow body 211, the spout 241 of the double-bag 204 is fixed to the second spout fixing portion 215 of the front cover 212. Thereafter, the rear cover 213 is attached to the opening portion 223 of the hollow body 211. In this way, the double-bag 204 containing deaerated ink can be housed within the cartridge case 201.

When disassembling the ink cartridge 200 after use, the front cover 212 is detached from the front opening portion 222, and then the double-bag 204 is removed via the opening portion 222. Thus, the double-bag 204 can be refilled, for example, without detaching the rear cover 213 from the hollow body 211.

Although this invention has been described in detail with reference to certain embodiments, variations and modifications exist within the scope and spirit of the invention as described and defined in the following claims.

The present application is based on Japanese Priority Application No. 2009-205193 filed Sep. 4, 2009, the entire contents of which are hereby incorporated by reference.

What is claimed is:

1. A liquid container comprising:

a case; and a liquid containing bag contained in the case, the liquid containing bag having a supply opening portion and configured to contain a liquid supplied to an image forming apparatus via the supply opening portion, wherein the case includes an integrally formed hollow body having a front opening portion, a rear opening portion, and a supply-opening fixing portion, the supply-opening fixing portion being disposed on a front end of the hollow body and to which the supply opening portion of the liquid containing bag is fixedly attached;

a front cover configured to cover the front opening portion of the hollow body; and a rear cover configured to cover the rear opening portion of the hollow body, wherein the front opening portion is disposed on an opposite side of the case from the rear opening portion, and has a size and configuration that permits the liquid containing bag to be removed by being pulled out of the hollow body via the front opening portion after the liquid has been dispensed from the liquid containing bag, and the rear opening portion has a size and configuration that permits the liquid containing bag filled with ink to be inserted into the hollow body via the rear opening portion.

2. The liquid container according to claim 1, wherein the case is shaped to follow a contour of the liquid containing bag.

3. The liquid container according to claim 2, wherein the case includes angled portions having gradually decreasing widths toward a front end and a rear end of the case when the liquid containing bag has decreasing widths toward a front end and a rear end.

4. The liquid container according to claim 3, wherein a buttressing rib is disposed on the angled portion of the case.

5. The liquid container according to claim 1, further comprising an ID chip disposed on a front surface of the case.

6. The liquid container according to claim 1, wherein the front cover includes a positioning member configured to define a position of the liquid container relative to the image forming apparatus when the liquid container is attached to the image forming apparatus.

7. The liquid container according to claim 6, wherein the positioning member is rib-shaped and extends from the front cover toward the rear cover parallel to a direction in which the liquid container is attached to the image forming apparatus.

8. The liquid container according to claim 1, wherein the liquid containing bag includes an inner bag configured to contain the liquid; and an outer bag in which the inner bag is housed and configured to apply pressure to the inner bag upon introduction of a gas into the outer bag so as to cause the liquid to flow out of the inner bag, wherein the outer bag contacts an inner wall surface of the case upon introduction of the gas into the outer bag.

9. The liquid container according to claim 8, wherein the outer bag has a volume greater than a volume of a portion of the case in which the outer bag is housed.

10. A method of assembling the liquid container according to claim 1, comprising the steps of:

inserting the liquid containing bag filled with the liquid into the hollow body via the rear opening portion;

attaching the supply opening portion of the liquid containing bag to the supply-opening fixing portion of the hollow body;

attaching the front cover to the front opening portion of the hollow body; and attaching the rear cover to the rear opening portion of the hollow body.

11. A method of disassembling the liquid container according to claim 1, comprising the steps of:

removing the front cover from the front opening portion of the hollow body; and pulling the liquid containing bag out of the hollow body via the front opening portion.

12. An image forming apparatus comprising the liquid container according to claim 1, wherein the liquid container is detachably attached to a hollow body of the image forming apparatus.

13. The liquid container according to claim 1, wherein a widest portion of a cross-section of the front opening portion of the case which is parallel to the rear opening portion of the case is wider than a widest portion of a cross-section of the liquid containing bag.

14. The liquid container according to claim 1, wherein the supply-opening fixing portion includes two parts, one of said two parts being disposed on an inner surface of the front cover.

15. The liquid container according to claim 1, wherein the liquid containing bag includes a spout portion which includes the supply opening portion, and the spout portion is inserted into the supply-opening fixing portion in a direction perpendicular to a direction along which the liquid containing bag is inserted into the case.

16. The liquid container according to claim 1, wherein the front opening portion of the case is smaller than the rear opening portion of the case.

17. The liquid container according to claim 1, wherein the front opening portion is a part through which a part of a front part of the case is open to expose an interior of the hollow body to outside of the case, and the open part of the front opening portion that exposes a part of the interior of the hollow body to outside of the case is configured to have a width that exposes an entirety of the supply-opening fixing portion which is placed in at least one of the front part of the case and the front cover.

18. The liquid container according to claim 1, wherein the rear opening portion is sized such that the hollow body is completely exposed through said rear opening portion.

19. The liquid container according to claim 1, wherein the case further includes a supply opening and an air inlet, and said supply opening and air inlet are placed in alignment in a longitudinal direction of a front face of the front cover, and the front opening portion is formed by splitting a front end part of the hollow body along a plane approximately passing through respective centers of the supply opening and the air inlet such that a part of the front end part of the hollow body is chipped off with respect to approximately a center of the front end part of the hollow body.

20. The liquid container according to claim 1, wherein the supply-opening fixing portion is provided at a front end of the front opening portion, and the supply opening portion of the liquid containing bag filled with the liquid is attached to the supply-opening fixing portion.

* * * * *